US008087892B1

(12) United States Patent
Liang

(10) Patent No.: US 8,087,892 B1
(45) Date of Patent: Jan. 3, 2012

(54) TURBINE BLADE WITH DUAL SERPENTINE FLOW CIRCUITS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 904 days.

(21) Appl. No.: 12/035,793

(22) Filed: Feb. 22, 2008

(51) Int. Cl.
*F01D 5/08* (2006.01)
*F01D 5/20* (2006.01)

(52) U.S. Cl. ..... 416/97 R; 416/96 R

(58) Field of Classification Search ..... 416/96 R, 416/97 R
See application file for complete search history.

(56) References Cited

U.S. PATENT DOCUMENTS 5,743,081 A * 4/1998 Reynolds ..... 60/39.17
6,132,169 A * 10/2000 Manning et al. ..... 415/115
6,220,817 B1 * 4/2001 Durgin et al. ..... 416/97 R
6,224,337 B1 * 5/2001 Lieland et al. ..... 416/97 R
7,008,186 B2 * 3/2006 Heeg et al. ..... 416/97 R
7,094,031 B2 * 8/2006 Lee et al. ..... 416/97 R
7,645,122 B1 * 1/2010 Liang ..... 416/97 R

* cited by examiner

*Primary Examiner* — Edward Look
*Assistant Examiner* — Adam W Brown
(74) *Attorney, Agent, or Firm* — John Ryznic

(57) ABSTRACT

A turbine blade for use in a high temperature environment and with low cooling flow. The blade includes a dual serpentine flow cooling circuit with a 5-pass serpentine circuit located along the leading edge and the tip section of the blade. A 3-pass serpentine circuit is formed within the 5-pass serpentine circuit with a third leg located along the trailing edge of the blade. A showerhead arrangement of film cooling holes on the leading edge is supplied by the first leg of the 5-pass serpentine circuit. Tip cooling holes are connected to the 5-pass serpentine circuit at the tip turns. The fifth leg of the 5 pass serpentine circuit discharges cooling air through film cooling holes on the pressure side wall and through the tip section. The inner legs of each of the dual serpentine circuits do not discharge cooling air through rows of film holes in order to provide for the low cooling flow.

15 Claims, 3 Drawing Sheets

TURBINE BLADE WITH DUAL SERPENTINE FLOW CIRCUITS

CROSS-REFERENCE TO RELATED APPLICATIONS

None.

FEDERAL RESEARCH STATEMENT

None.

BACKGROUND OF THE INVENTION

1. Field of the Invention

The present invention relates generally to a gas turbine engine, and more specifically to a turbine blade with tip region cooling.

2. Description of the Related Art Including Information Disclosed Under 37 CFR 1.97 and 1.98

In a gas turbine engine, a compressor delivers compressed air to a combustor in which the compressed air is burned with a fuel to produce a high temperature gas flow which is then passed through a turbine to convert the energy in the hot gas flow into mechanical work used to drive the rotor shaft of the engine. The engine efficiency can be increased by passing a higher temperature gas into the turbine. However, material properties and cooling limitations limit the turbine inlet temperature.

One method designers can allow for higher turbine inlet temperatures is to provide higher cooling capability with the pressurized cooling air supplied to the turbine airfoils (rotor blades and stator vanes). Since the first stage turbine airfoils are exposed to the highest temperature gas flow, these airfoils require the most cooling, FIG. 1 shows a prior art first stage turbine blade external heat transfer coefficient profile. As indicated by the figure, the airfoil leading edge, the suction side immediately downstream of the leading edge, as well as the pressure side trailing edge region of the airfoil experience higher hot gas side external heat transfer coefficient than the mid-chord section of the pressure side and downstream of the suction surfaces. In general, the heat load for the airfoil aft section is higher than the forward section.

Another method used to allow for higher turbine inlet temperatures is to apply a TBC (thermal barrier coating) to the airfoils to provide a thermal protection. As the TBC technology improves, more industrial gas turbine (IGT) blades are applied with a thick or low conductivity TBC. With a thicker TBC, the cooling flow demand is reduced. As a result of this, there is not sufficient cooling flow for the design to split the total cooling flow into three flow circuits and utilize the forward flowing serpentine cooling concept of the prior art. Cooling flow for the blade leading and trailing edges has to be combined with the mid-chord flow circuit to form a single 5-pass serpentine flow circuit. However, for a forward flow 5-pass serpentine circuit with total blade cooling flow, BFM (back flow margin, when the airfoil outside pressure is lower higher than the airfoil inside pressure and the hot gas flows into the airfoil cooling circuitry) may become a design issue. In addition, a single 5-pass aft flowing serpentine circuit for a large chord blade design may yield too high of a cooling air temperature when the cooling air reaches to the airfoil trailing edge section. Thus, a loss of cooling potential for the cooling air to achieve a design metal temperature occurs.

BRIEF SUMMARY OF THE INVENTION

It is an object of the present invention to provide for a turbine blade with a cooling circuit with increased aft section cooling that can be used in a high temperature turbine blade cooling design.

It is another object of the present invention to provide for a turbine blade with a cooling circuit with increased aft section cooling that can be used in a high temperature turbine blade cooling design that can be used with a TBC at low cooling flow.

The present invention is a turbine blade with a dual aft flowing serpentine cooling flow circuit for use in a large chord turbine rotor blade. The duel cooling circuit includes 5-pass serpentine circuit with a 3-pass serpentine circuit passing underneath the 5-pass circuit. The 5-pass serpentine circuit includes a first leg extending along the leading edge of the airfoil and the fourth and fifth legs extending along the trailing edge region. The 3-pass serpentine includes the first and second legs positioned between the third and fourth legs of the 5-pass serpentine. The last leg of the 3-pass serpentine extends along the trailing edge to discharge cooling air out through trailing edge exit holes or slots. Portions of the 5-pass serpentine circuit pass along the tip region and discharge cooling air into a squealer tip. A leading edge showerhead discharges cooling air from the first leg of the 5-pass serpentine while the last leg of the 5-pass serpentine circuit discharges film cooling air through a row of pressure side film holes.

DETAILED DESCRIPTION OF THE INVENTION

Figure 1:
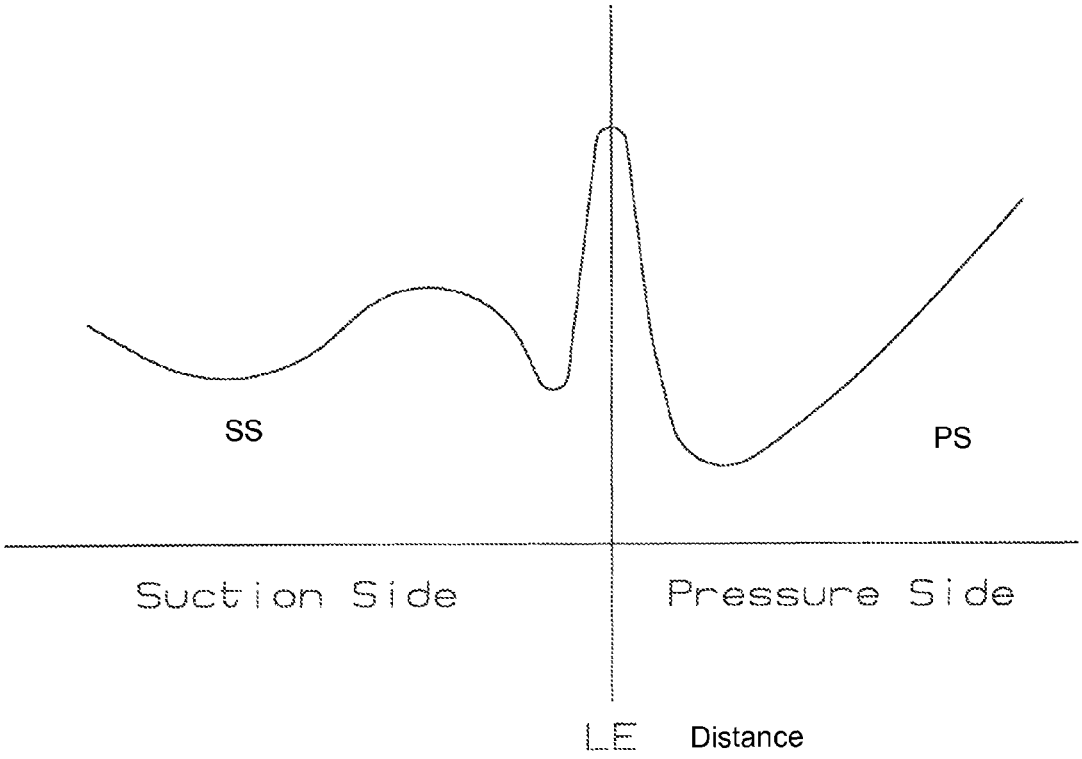
Fig 1 Prior Art
FIG. 1 shows a prior art first stage turbine blade external heat transfer coefficient profile in graph form.
Figure 2:
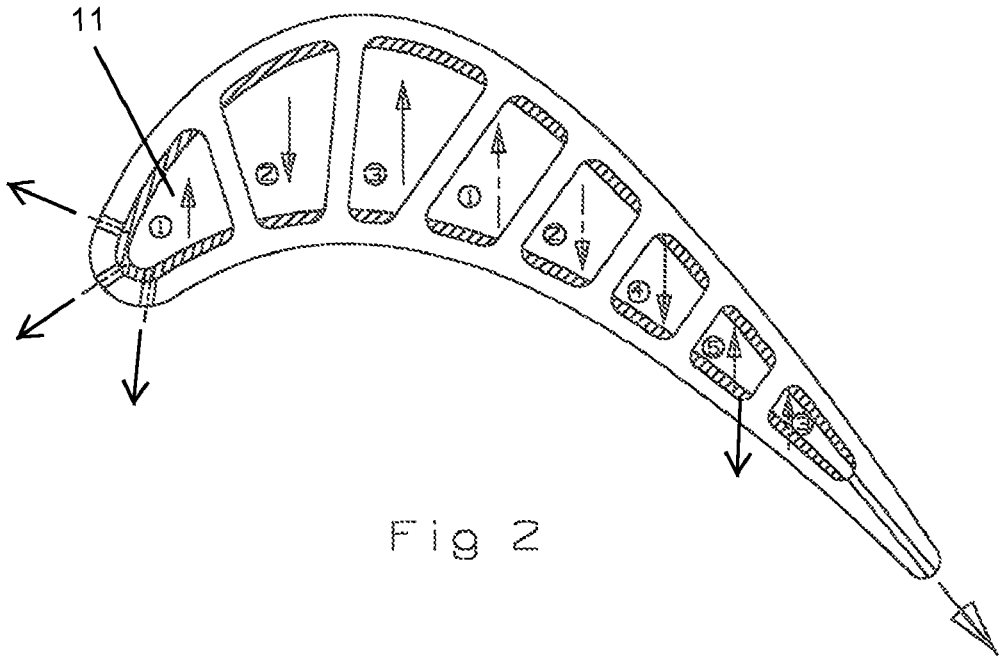
FIG. 2 shows a cross section top view of the dual serpentine flow cooling circuit of the present invention.

FIG. 2 shows a top cross section view of the dual serpentine flow cooling circuit for a first stage turbine blade used in an industrial gas turbine engine. The blade includes a leading edge with a first leg 11 of a 5-pass serpentine flow circuit extending along the leading edge and connected to a showerhead arrangement of film cooling holes. A second leg 12 and a third leg 13 of the 5-pass serpentine circuit are positioned aft of the first leg 11. The fourth leg 14 and the fifth leg 15 are located along the trailing edge region but not adjacent to the third leg 13. The fifth leg 15 includes a row of film cooling holes along the pressure side of the airfoil to discharge cooling air from the 5-pass serpentine circuit.

Figure 3:
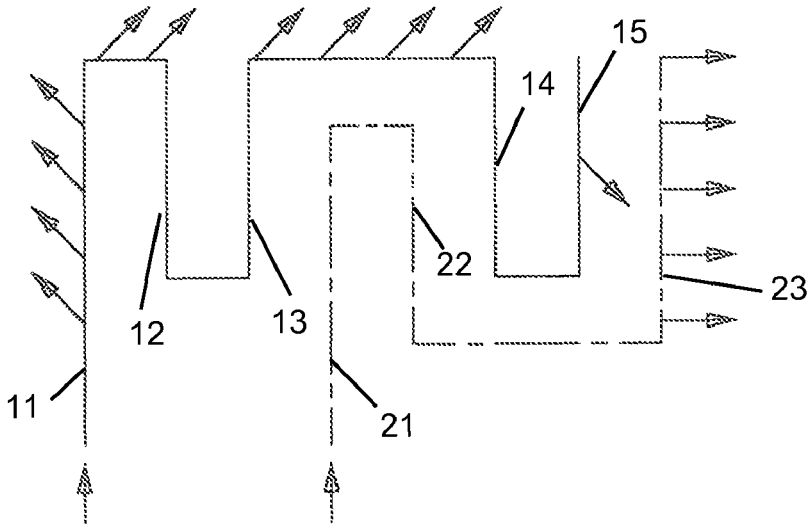
FIG. 3 shows a diagram view of the flow circuit arrangement of the dual serpentine circuit of FIG. 2 of the present invention.

The dual serpentine circuit also includes a 3-pass serpentine flow circuit with a first leg 21, a second leg 22 and a third leg 23 forming an aft flowing serpentine within the blade. The first and the second legs 21 and 22 are positioned between the third leg 13 and the fourth leg 14 of the 5-pass serpentine as seen in FIG. 2 and FIG. 3. The third and last leg 23 of the 3-pass serpentine extends along the trailing edge of the blade and is connected to a row of exit holes or slots that discharge cooling air from the airfoil.

FIG. 3 shows a diagram view of the dual serpentine cooling circuit. The 5-pass serpentine includes tip turns with cooling holes to discharge cooling air through the tip of the blade. The first leg 11 to second leg 12 tip turn and the third leg 13 to fourth leg 14 tip turns both include cooling holes on the tip to discharge some of the cooling air flowing through the 5-pass serpentine circuit.

Figure 4:
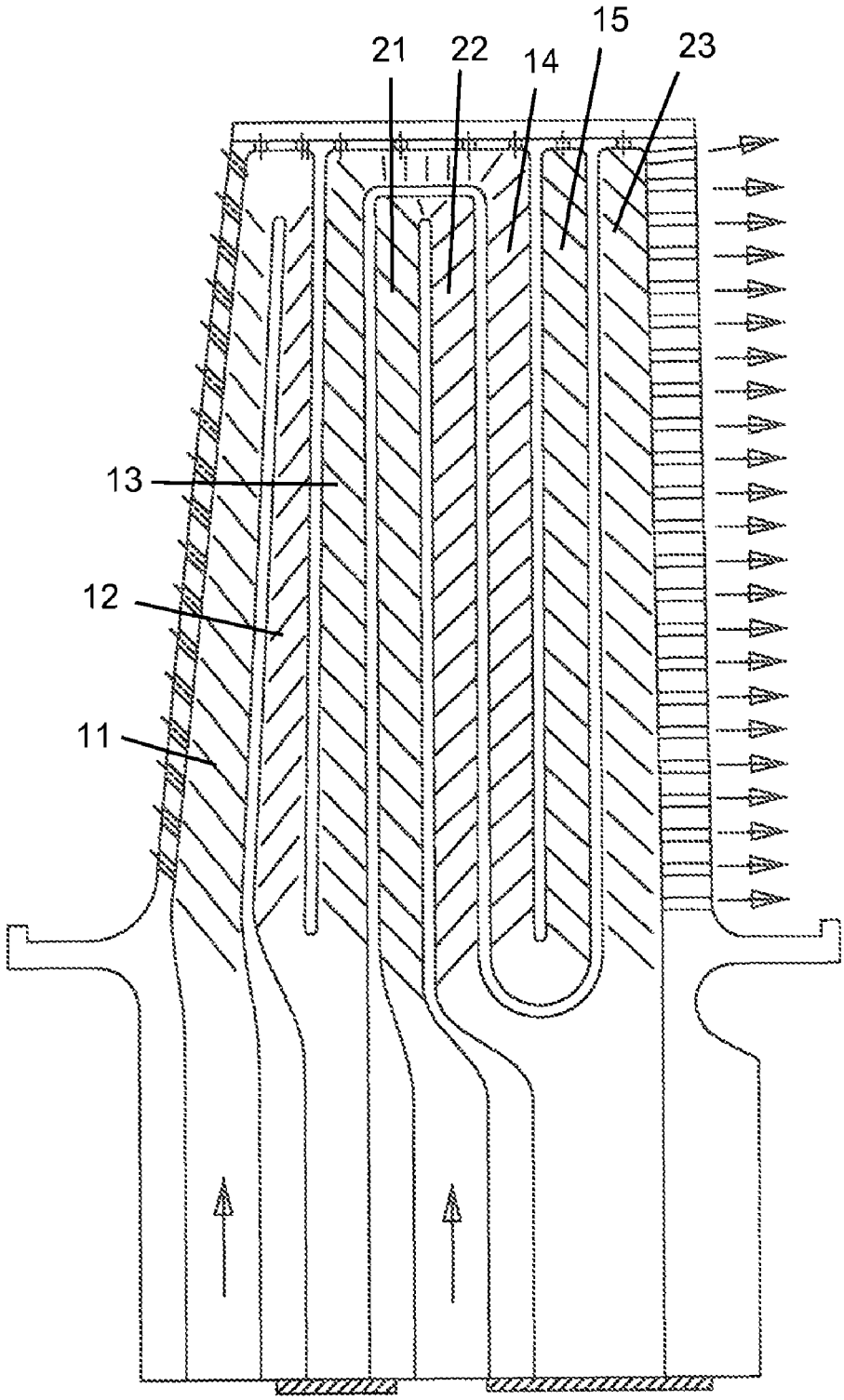
FIG. 4 shows a cross section side view of the dual serpentine flow cooling circuit of the present invention.

FIG. 4 shows a side view of the dual serpentine flow cooling circuit of the present invention. The legs of the 5-pass and the 3-pass serpentines extend from the platform to the tip of the blade. The showerhead film holes are located along the leading edge of the blade and are connected to the first leg 11. The exit holes are arranged along the trailing edge and are connected to the third leg 23 of the 3-pass serpentine circuit. The tip holes are shown in the tip turns and at the end of the fifth leg 15. The cooling air flowing around the tip turns will also produce an impingement cooling effect to the underside of the tip of the blade. Skewed trip strips are positioned along the pressure side and suction side walls of each channel in the serpentine circuits to enhance the heat transfer coefficient. Each of the legs or channels of the dual serpentine circuits extends from the pressure side wall to the suction side wall as seen in FIG. 2.

In the dual serpentine cooling circuit of the present invention, an aft flowing 5-pass serpentine flow cooling circuit is used for the entire blade as a single cooling flow circuitry. Showerhead cooling is also used in this cooling circuit design. However, due to the low cooling flow consumption, backside impingement for the airfoil leading edge region cannot be implemented in this 5-pass serpentine flow cooling circuit. The total blade cooling air is fed through the blade leading edge section and then flows aft toward the trailing edge. Cooling air is bled off from the first leg of the 5-pass serpentine circuit and discharged through the leading edge showerhead film cooling holes to form a film cooling layer to cool the blade leading edge where the heat load is the highest on the entire airfoil. For the blade tip section cooling arrangement, the tip section film cooling is achieved by bleed off cooling air from the pressure side film cooling holes, upstream of the airfoil trailing edge, to provide film cooling for the airfoil trailing edge corner.

Since the heat load at the aft portion of the airfoil is higher than the forward section while the cooling air for the 5-pass serpentine circuit may be too warm for the cooling of the blade trailing edge root section to achieve the root section metal temperature requirement, a separately fed 3-pass serpentine is incorporated into the 5-pass aft flowing serpentine circuit at the third leg and fourth leg location for cooling of the blade trailing edge root section region as well as to provide cooling for the airfoil trailing edge. In the 3-pass serpentine flow cooling circuit of the present invention, there is no cooling air bleed off from the tip turn for the cooling of the blade tip portion. All of the cooling air is discharged through the airfoil trailing edge cooling holes. In addition, an open root turn is incorporated in the serpentine cooling design. The elimination of traditional root turn geometry thus eliminates the constraint to the cooling flow during the turn, which allows the cooling air to form a free stream tube at the blade root turn region. Other than the aerodynamic root turn design benefit, the open serpentine root turn also greatly improves the serpentine ceramic core support to achieve a better casting yield and cooling flow addition through the metering plate at the entrance to the serpentines.

Several major design features and advantages of the dual serpentine flow cooling circuits of the present invention over the prior art 5-pass forward flowing serpentine circuit are described below.

Minimize the blade BFM issue.

The blade total cooling air fed through the airfoil forward section and flowing toward airfoil trailing edge maximizes the use of the cooling pressure potential.

Higher cooling mass flow through the airfoil main body yields a lower mass average blade metal temperature which results in a higher stress rupture life for the blade.

Blade total cooling flow is fed through the airfoil pressure side forward section where the external gas side heat load is low. Since the cooling air temperature is fresh, as a result of the cooling air feed system the maximum use of cooling air potential to achieve a non-film cooling zone for the airfoil is accomplished. Elimination of leading edge pressure side and suction side gill holes becomes feasible.

The aft flowing 5-pass serpentine flow cooling circuit maximizes the use of cooling air and provides a very high overall cooling efficiency for the entire airfoil, especially for the pressure side trailing edge film cooling channeled through the entire 5-pass serpentine flow circuit and then used as film cooling for the blade trailing edge.

The aft flowing serpentine cooling flow circuit used for the airfoil main body will maximize the use of cooling to main stream gas side pressure potential. Majority of the cooling air for the 5-pass serpentine is discharged at the aft section of the airfoil where the gas side pressure is low and thus yields a high cooling air to main stream pressure potential to be used for the serpentine channels and maximize the internal cooling performance for the serpentine.

The aft flowing main body 5-pass serpentine flow channel yields a lower cooling supply pressure requirement and lower leakage.

Elimination of serpentine root turn geometry constraint thus improves the casting yield for the 3-pass serpentine circuit. Open root turn concept improves serpentine turn loss and increases cooling flow addition design flexibility.

The 3-pass serpentine cooling circuit for the aft portion of the blade yields a lower and more uniform blade sectional mass average temperature which improves blade creep life capability.

The dedicated trailing edge cooling circuit provides cooler cooling air for the blade root section and thus improves airfoil high cycle fatigue (HCF) capability.

The current 5-pass and 3-pass serpentine cooling design provides greater cooling design flexibility for the airfoil. Individual cooling flow channels can be separately addressed for the airfoil heat load. The 5-pass serpentine is designed for the cooling of blade leading edge and the tip section. The 3-pass serpentine is designed for the blade trailing edge cooling only. Thus, the dual serpentine circuit maximizes the airfoil oxidation resistance capability and allows for a higher operating temperature for future engine upgrades.

I claim the following:

1. A turbine blade comprising:

a 5-pass serpentine flow cooling circuit with a first leg located adjacent to a leading edge region of an airfoil, each of the legs of the 5-pass serpentine circuit extending from a blade platform to a blade tip section;

a 3-pass serpentine flow cooling circuit with a first leg and a second leg positioned between the third leg and the fourth leg of the 5-pass serpentine circuit;

the fourth leg and the fifth leg of the 5-pass serpentine circuit positioned between the second leg and the third leg of the 3-pass serpentine flow circuit;

a row of trailing edge exit cooling holes connected to the third leg of the 3-pass serpentine circuit; and, a showerhead arrangement of film cooling holes connected to the first leg of the 5-pass serpentine circuit.

2. The turbine blade of claim 1, and further comprising:
the 5-pass serpentine circuit including tip turns with tip cooling holes to discharge cooling air from the 5-pass serpentine circuit out through the tip section of the blade.

3. The turbine blade of claim 1, and further comprising:
the second, third and fourth legs of the 5-pass serpentine circuit and the first and second legs of the 3-pass serpentine circuit do not have a row of film cooling holes that discharge cooling air from the respective serpentine circuit.

4. The turbine blade of claim 1, and further comprising:
the fifth leg of the 5-pass serpentine circuit includes a row of film cooling holes along the pressure side of the airfoil.

5. The turbine blade of claim 4, and further comprising:
the fifth leg of the 5-pass serpentine circuit includes a tip section cooling hole at the end of the fifth leg.

6. The turbine blade of claim 1, and further comprising:
each of the legs of the 5-pass and the 3-pass serpentine circuits includes legs that extend between the pressure and suction side walls of the airfoil.

7. The turbine blade of claim 1, and further comprising:
the third leg of the 3-pass serpentine circuit includes a tip section cooling hole at the end of the third leg.

8. The turbine blade of claim 2, and further comprising:
the second, third and fourth legs of the 5-pass serpentine circuit and the first and second legs of the 3-pass serpentine circuit do not have a row of film cooling holes that discharge cooling air from the respective serpentine circuit.

9. The turbine blade of claim 8, and further comprising:
the fifth leg of the 5-pass serpentine circuit includes a row of film cooling holes along the pressure side of the airfoil.

10. The turbine blade of claim 9, and further comprising:
the fifth leg of the 5-pass serpentine circuit includes a tip section cooling hole at the end of the fifth leg.

11. The turbine blade of claim 10, and further comprising:
each of the legs of the 5-pass and the 3-pass serpentine circuits includes legs that extend between the pressure and suction side walls of the airfoil.

12. The turbine blade of claim 11, and further comprising:
the third leg of the 3-pass serpentine circuit includes a tip section cooling hole at the end of the third leg.

13. The turbine blade of claim 1, and further comprising:
the turbine blade is a large chord turbine blade for an industrial gas turbine engine.

14. The turbine blade of claim 1, and further comprising:
both the 5-pass and the 3-pass serpentine circuits are aft flowing serpentine circuits.

15. The turbine blade of claim 1, and further comprising:
the blade is coated with a TBC and is a low cooling flow blade.

* * * * *